United States Patent [19]

Günther et al.

[11] Patent Number: 4,938,146

[45] Date of Patent: Jul. 3, 1990

[54] GRENADE-TYPE PROJECTILE

[75] Inventors: Michael Günther, Meerbusch; Wolfgang Graupner, Düsseldorf, both of Fed. Rep. of Germany

[73] Assignee: Rheinmetall GmbH, Düsseldorf, Fed. Rep. of Germany

[21] Appl. No.: 410,521

[22] Filed: Sep. 22, 1989

[30] Foreign Application Priority Data

Sep. 22, 1988 [DE] Fed. Rep. of Germany ... 8812000[U]

[51] Int. Cl.[5] ..... F42B 5/067

[52] U.S. Cl. ..... 102/439; 102/430; 102/469; 102/476

[58] Field of Search ..... 102/430, 439, 443, 476, 102/464, 469, 470, 491, 493

[56] References Cited

U.S. PATENT DOCUMENTS

| | | | |
|---|---|---|---|
| 2,872,864 | 2/1959 | Barnes et al. | 102/439 |
| 3,547,030 | 12/1970 | Kamp et al. | 102/430 |
| 3,913,483 | 10/1975 | Wolterman | 102/476 |
| 4,762,068 | 8/1988 | Lubbers | 102/439 |
| 4,763,577 | 8/1988 | Romer et al. | 102/430 |
| 4,815,387 | 3/1989 | Lubbers | 102/439 |

FOREIGN PATENT DOCUMENTS

| | | | |
|---|---|---|---|
| 279301 | 8/1988 | European Pat. Off. . | |
| 2262981 | 7/1973 | Fed. Rep. of Germany . | |
| 3149430 | 8/1982 | Fed. Rep. of Germany . | |
| 79338 | 1/1934 | Sweden | 102/439 |

*Primary Examiner*—Harold J. Tudor

*Attorney, Agent, or Firm*—Spencer & Frank

[57] ABSTRACT

An ammunition comprises a cartridge casing and a propellant unit disposed in the cartridge casing including a propellant housing having a length oriented codirectionally with the length of the cartridge casing, a rear terminal portion held in a rear base of the casing and a frontal terminal portion provided with an external thread. The ammunition further has a projectile housing having a rear length portion received in the frontal end portion of the cartridge casing; and an annular sleeve affixed to the exterior face of the projectile housing base and being in alignment with the propellant housing. The annular sleeve has an internal thread being in a threaded engagement with the external thread of the propellant housing and weakened portions immediately adjacent the exterior face for causing a rupture of the annular sleeve in response to a predetermined propelling force seeking to separate the projectile housing from the cartridge casing upon igniting the propellant.

1 Claim, 1 Drawing Sheet

GRENADE-TYPE PROJECTILE

BACKGROUND OF THE INVENTION

This invention relates to a grenade-type projectile having a shaped charge liner and a fragment-forming, possibly pre-fragmented projectile housing. The projectile is designed for being fired, for example, from a 40-mm grenade pistol for use against armored targets and has a simultaneous side-spray effect. The grenade-type projectile has a range of about 300 to 400 m.

Grenade-type projectiles of the above-outlined type are fired from cartridge casings which are provided with a free space below the projectile bottom to serve as the gas pressure chamber. The propelling charge powder proper is disposed in a central propellant unit at the bottom of the cartridge casing.

Projectile and cartridge casing are conventionally connected with one another by a detent or snap-in connection; they may additionally be bonded together by an adhesive. To protect the projectile against environmental influences (moisture), the region of the connection is often also coated by a layer of protective lacquer. These measures, however, result in irregular forces that separate the projectile from the cartridge casing when fired, leading to non-uniform initial starting velocities and poor accuracy.

German Offenlegungsschrift (non-examined published application) 3,507,643, to which correspond U.S. Pat. Nos. 4,762,068 and 4,815,387, solved the above problem for a 40-mm caliber smoke-screen cartridge including a tracer lining by providing a firm and form-locking screw connection between a structurally long propellant unit and a thick-walled, rearwardly screwed-in smoke-screen projectile base. Once a desired break location has ruptured in the propellant unit, the front portion of the thread of the propellant unit remains attached to the projectile base, and a telescoping sleeve system is intended to initially prevent the propelling charge gases from reaching the free space in the cartridge casing at the beginning of projectile acceleration. Only after the telescoping sleeves, of which the inner sleeve remains connected with the projectile body, have been pulled apart and lose their sealing contact, will the propelling charge gases reach the already greatly enlarged free space in the cartridge casing. This, however, results in a considerable loss in pressure or in pressure fluctuations and no uniform acceleration can be realized for the projectile.

Since smoke-screen projectiles need not have as high a hit accuracy as live ammunition, the above-outlined known tear-away connection is well suited for smoke-screen projectiles or similar projectiles which include a tracer and other payload, such as charges generating a flash, noise, color and/or smoke. The prior art arrangement, however, is not suitable for live ammunition having a thin-walled base and no tracer lining, in which only little room is available in the cartridge casing below the projectile base.

SUMMARY OF THE INVENTION

It is therefore an object of the present invention to provide an improved ammunition in which a firm and form-locking connection between the propellant unit, the cartridge casing and a live combat grenade-type projectile is ensured. The connection ruptures upon firing, permitting uniform pressure buildup with uniform projectile acceleration and ensures a consistently high hit accuracy by producing reproducible, constant initial velocities without disadvantageous effects on the projectile.

This object and others to become apparent as the specification progresses, are accomplished by the invention, according to which, briefly stated, the ammunition comprises a cartridge casing and a propellant unit disposed in the cartridge casing including a propellant housing having a length oriented codirectionally with the length of the cartridge casing, a rear terminal portion held in a rear base of the casing and a frontal terminal portion provided with an external thread. The ammunition further has a projectile housing having a rear length portion received in the frontal end portion of the cartridge casing; and an annular sleeve affixed to the exterior face of the projectile housing base and being in alignment with the propellant housing. The annular sleeve has an internal thread being in a threaded engagement with the external thread of the propellant housing and weakened portions immediately adjacent the exterior face for causing a rupture of the annular sleeve in response to a predetermined propelling force seeking to separate the projectile housing from the cartridge casing upon igniting the propellant.

Advantageously, no residues of the connection remain at the projectile itself. After removal of the threaded sleeve from the thread on the propellant housing once the threaded sleeve has torn away from the projectile base, the cartridge casing and the propellant housing can advantageously be reused.

DESCRIPTION OF THE PREFERRED EMBODIMENT

Figure 1:
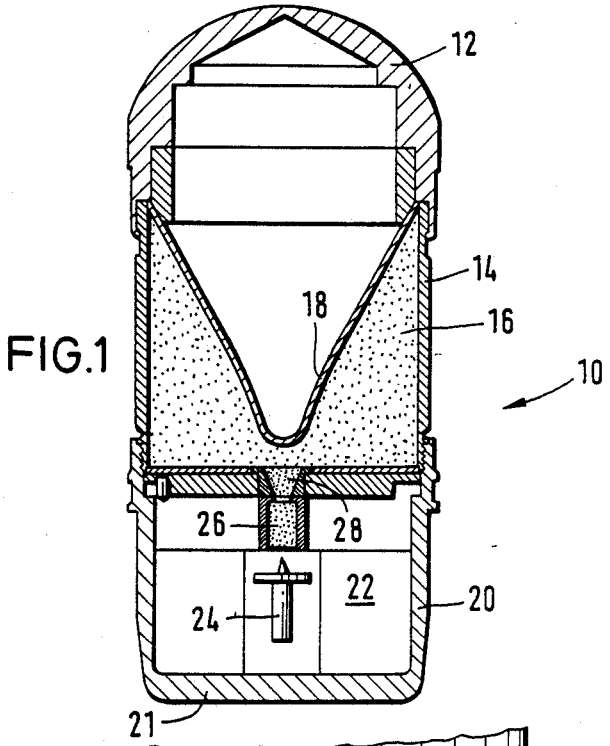
FIG. 1 is an axial longitudinal sectional view of a live grenade-type projectile designed to incorporate the invention.

In FIG. 1, the reference numeral 10 identifies a live grenade-type projectile having, for example, a caliber of 40 mm. At its tip, the grenade-type projectile has a payload composed of a specially shaped stand-off head cap 12, made, for example, of an aluminum alloy or a plastic, a cylindrical, steel or heavy metal projectile body 14, which may be pre-fragmented, accommodating an explosive charge 16 and a shaped charge liner 18 of generally conical (trumpet-shaped) configuration.

The cylindrical projectile body 14 is adjoined in a rearward direction by a one-piece, thin-walled projectile housing 20 made, for example, of steel or an aluminum alloy, having a smooth projectile base 21 which is flush with the projectile body 14 and which includes an impact fuze formed as a base fuze 22. The base fuze 22 is shown only schematically; it has an axially movable firing pin 24, a detonator charge 26 and a transfer and booster charge 28 which is in communication with the explosive charge 16.

The interior of the projectile housing 20 is filled completely by the base fuze 22 and no tracer assembly is provided.

Figure 2:
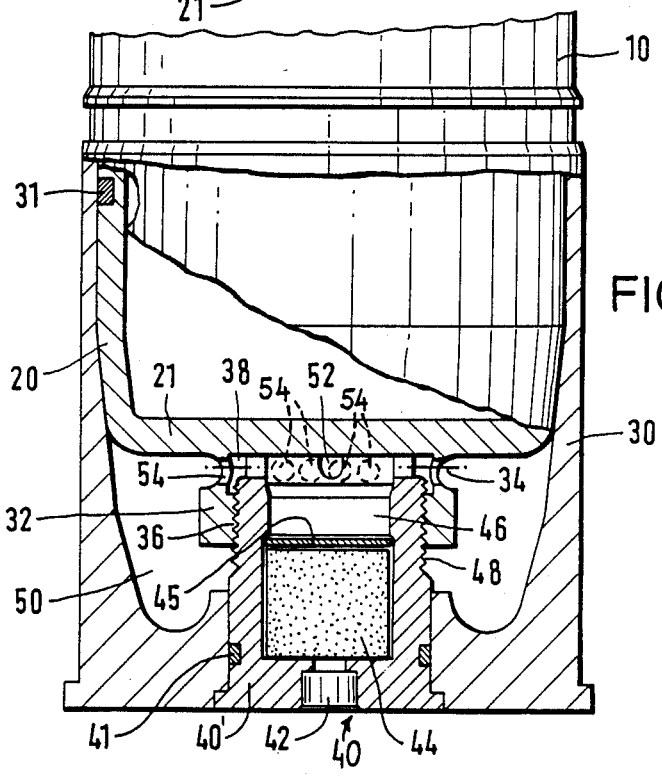
FIG. 2 is an axial sectional view of a casing-andprojectile assembly according to a preferred embodiment.

The invention, now to be described in conjunction with FIG. 2, is intended for incorporation in a grenade-type projectile as set forth above.

As shown in FIG. 2, the rear housing portion 20 of the grenade-type projectile is inserted completely into a cylindrical cartridge casing 30 which is expediently made of an aluminum alloy or plastic and which includes a central propellant unit 40. A firm connection between the projectile and the cartridge casing 30 is effected by means of the tight tear-away screw connection according to the invention between the propellant unit 40 and the grenade-type projectile 10. Thus, a snap-in or glue connection at the front between the cartridge casing and the grenade-type projectile is no longer necessary. To seal the projectile against environmental influences, an elastic circumferential sealing ring 31 is received in a circumferential groove of the projectile housing 20 and contacts the inner surface of the cartridge casing 30 along and adjacent the frontal terminal edge thereof.

A rearwardly projecting axial annular sleeve 32 is provided on the exterior of the projectile base 21 and is firmly connected therewith. Immediately at the projectile base 21, the sleeve 32 is provided with a desired location of rupture formed of an external circumferential annular groove 34 constituting the tear-away connection according to the invention.

The annular sleeve 32 is provided with an internal thread 36 which, in the direction of the projectile base 21, terminates in a smooth bore, constituting an annular groove 38 which is disposed immediately at the projectile base 21 and forms an annular channel for equalizing the gas pressure and a gas passage for the propelling gases.

Centrally in the base of the cartridge casing 30 there is inserted the propellant unit 40 which is sealed by means of a sealing ring 41. The propellant unit 40 has a generally cylindrical propellant housing 40′ which is provided at its bottom with an impact sensitive primer capsule 42 for igniting the propelling charge 44 held in the propellant housing 40′ by means of a rupture disc 45. The propellant housing 40′ is open toward the projectile base 21 and has a free space 46 in front of the propelling charge 44 and the rupture disc 45.

At its outer circumference, the propellant housing 40′ is provided with an external thread 48 which corresponds with the internal thread 36 of the sleeve 32. The threaded engagement between the two threads 36 and 48 results in a firm seat for the propellant unit 40 and the projectile 10 in the cartridge casing 30. The propellant unit 40 may be screwed into the sleeve 32 until the frontal end face of the propellant housing 40′ abuts against the outer face of the projectile base 21.

In order for the propelling charge gas to reach a free space 50 below the projectile base 21 within the cartridge casing 30 so as to eject and accelerate the projectile, several recesses 52 (preferably four in number) are provided as gas passages in the frontal end face of the propellant housing 40′. Corresponding gas passage bores 54 are provided within the annular groove 34 of the sleeve 32, immediately adjacent the projectile base 21.

According to a significant feature of the invention, the propellant unit 40 has a very short length in the direction of the projectile: such length approximately equals the diameter of the propellant unit (that is, the length and diameter of the housing 40′). The weakened material of the sleeve projection 32 to form the desired break location may be obtained by providing a large number of the bores 54 positioned closely to one another. In such a case, the annular groove 34 can be dispensed with.

If a greater amount of propelling charge powder is to be accommodated in the housing 40′, the front portion of the housing 40′, that is, the region of its frontal external thread 48, is provided with a smaller diameter than the rear region where it is fastened to the cartridge casing 30. Thus, at that location, the propellant housing 40′ has a larger diameter than in prior arrangements.

The build-up of pressure in the free space 46 of the propellant unit 40 and in the free space 50 of the cartridge casing 30 can be set positively by way of the size and number of recesses 52 in the frontal face of the propellant housing 40′. As noted before, to provide a desired break location in the sleeve 32, its wall is weakened by providing therein a plurality of circumferentially arranged bore holes 54 and/or by setting the depth of the external annular groove 34. With these measures the strength of the wall of the sleeve 32 is positively set to determine in advance the moment at which the material is no longer able to withstand a certain, preselectable gas pressure, whereupon the otherwise firm connection between the projectile 10 and the casing 30 ruptures.

In the description which follows, the operation of the device according to the invention will be set forth.

After striking the primer capsule (percussion cap) 42 and burning the propellant charge 44, the pressure in the free space 46 of the propellant housing 40′ increases. Propelling gas is introduced through the openings 52, the annular channel 38 and the bores 54 into the free space 50 of the cartridge casing 30 and the pressure is increased therein.

As soon as the gas pressure in the free spaces 46 and 50 (gas pressure chambers) has reached a defined level, the annular sleeve 32 ruptures at the desired break location directly a the projectile base 21 and the projectile is propelled uniformly out of the cartridge casing 30 without disadvantageous pressure fluctuations and is accelerated so that the separate, acceleration-dependent safety elements of the base fuze, which become effective before the spindependent elements, are reliably moved from the initial or safety position to the live (armed) operational position before the projectile reaches the muzzle.

It will be understood that the above description of the present invention is susceptible to various modifications, changes and adaptations, and the same are intended to be comprehended within the meaning and range of equivalents of the appended claims.

What is claimed is:

1. Ammunition comprising (a) a cartridge casing having a length, a frontal end portion and a rear base;

(b) a propellant unit disposed in the cartridge casing and having a generally cylindrical propellant housing having a length oriented codirectionally with the length of the cartridge casing, a rear terminal portion held in said rear base and a frontal terminal portion provided with an external thread; said housing having a diameter at least approximately corresponding to the length thereof; said housing accommodating a propellant;

(c) a projectile housing having a length, a thinwalled and generally bowl-shaped rear length portion, a fragmentation length portion situated in front of said rear length portion, and a rear base constituting a rear terminus of said rear length portion; said rear length portion of said projectile being received in said frontal end portion of said cartridge casing; said rear base of said projectile housing having an exterior face oriented towards the rear base of said cartridge casing;

(d) an explosive charge accommodated in said fragmentation length portion;

(e) a forwardly acting shaped charge liner bounding said explosive charge at a front end thereof;

(f) a fuze accommodated in said rear length portion;

(g) an annular sleeve affixed to said exterior face and being in alignment with said propellant housing; said annular sleeve having (1) an internal thread being in a threaded engagement with the external thread of said propellant housing; and (2) means defining weakened portions immediately adjacent said exterior face for causing a rupture of said annular sleeve at said weakened portions in response to a predetermined propelling force seeking to separate said projectile housing from said cartridge casing upon igniting said propellant.

2. An ammunition as defined in claim 1, wherein said means defining weakened portions define an external circumferential groove in said annular sleeve.

3. An ammunition as defined in claim 1, wherein said annular sleeve has an inner circumferential groove immediately adjoining said exterior face of said rear base.

4. An ammunition as defined in claim 1, wherein said frontal terminal portion of said propellant housing has a plurality of propellant gas passages.

5. An ammunition as defined in claim 4, wherein said annular sleeve has an inner circumferential groove immediately adjoining said exterior face of said rear base; further comprising a plurality of throughgoing propellant gas passages provided in said annular sleeve, in said inner circumferential groove thereof.

6. An ammunition as defined in claim 1, wherein said means defining weakened portions define a plurality of throughgoing holes arranged circumferentially and spaced close to one another.

7. An ammunition as defined in claim 1, wherein said frontal terminal portion of said propellant housing has a diameter which is smaller than a diameter of said rear terminal portion of said propellant housing.

* * * * *